United States Patent [19]

Young

[11] 4,083,558

[45] Apr. 11, 1978

[54] METHOD OF PLAYING A GAME OF CHANCE

[76] Inventor: Carl Wilfred Young, 284½ Manhattan Dr., Burlington, Vt. 05401

[21] Appl. No.: 734,087

[22] Filed: Oct. 20, 1976

[51] Int. Cl.[2] ..... A63F 9/00

[52] U.S. Cl. ..... 273/1 R

[58] Field of Search ..... 273/1 R, 141 R, 146, 273/135 AA

[56] References Cited

U.S. PATENT DOCUMENTS

| | | | |
|---|---|---|---|
| 1,598,611 | 9/1926 | Humphreys | 273/146 |
| 2,861,809 | 11/1958 | Fischl | 273/141 R |
| 3,850,434 | 11/1974 | Ockenfels | 273/135 AA |

FOREIGN PATENT DOCUMENTS

| | | | |
|---|---|---|---|
| 964,296 | 7/1964 | United Kingdom | 273/146 |
| 757,509 | 9/1956 | United Kingdom | 273/146 |

*Primary Examiner*—Paul E. Shapiro
*Attorney, Agent, or Firm*—Thomas N. Neiman

[57] ABSTRACT

The invention is of a method of playing a game of chance comprising, according to the embodiment described, a plurality of dice and a deck of game cards. The cards, according to the described embodiment, prescribe a variety of minimum goals for the player. The overall goal of an individual or team consists of achieving a prescribed number of points prior to the opposing individual or team. The novel method includes the steps of assigning a predetermined point to at least one given die face and one plurality of a given die face; then, taking a card and noting the point value; throwing the dice and noting the values on the die faces and the pluralities thereof; noting any underachievement of the point goal and throwing the non-point yielding die to equal or exceed the desired point goal.

7 Claims, 1 Drawing Figure

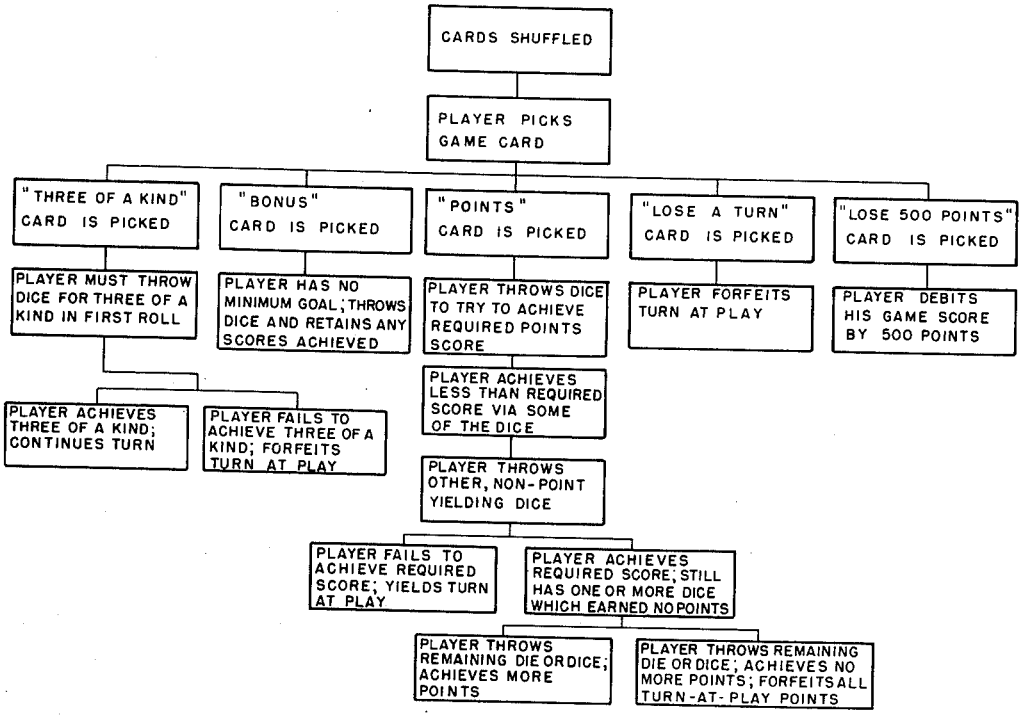

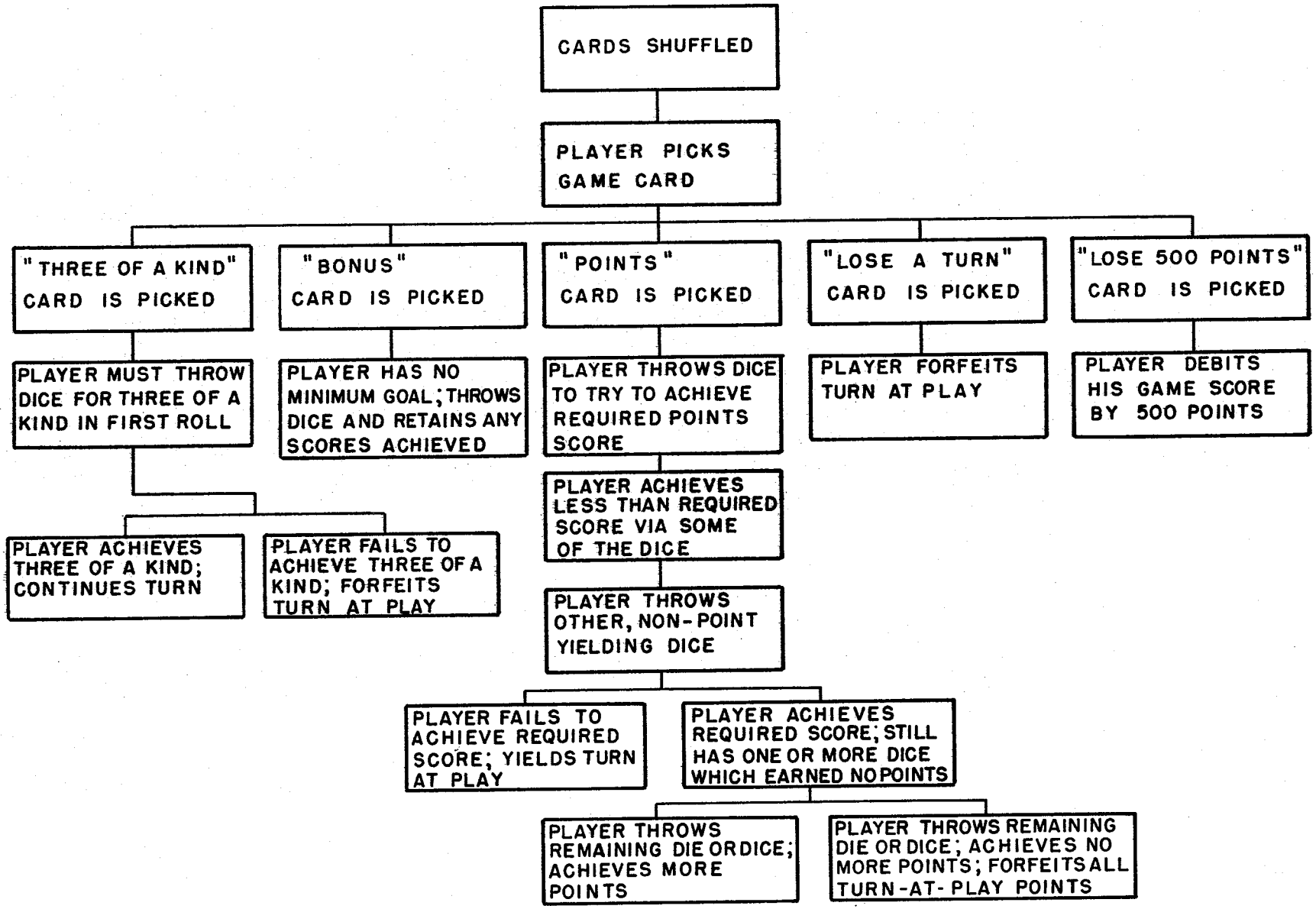
CARDS SHUFFLED
PLAYER PICKS GAME CARD
"THREE OF A KIND" CARD IS PICKED
"BONUS" CARD IS PICKED
"POINTS" CARD IS PICKED
"LOSE A TURN" CARD IS PICKED
"LOSE 500 POINTS" CARD IS PICKED
PLAYER MUST THROW DICE FOR THREE OF A KIND IN FIRST ROLL
PLAYER HAS NO MINIMUM GOAL; THROWS DICE AND RETAINS ANY SCORES ACHIEVED
PLAYER THROWS DICE TO TRY TO ACHIEVE REQUIRED POINTS SCORE
PLAYER FORFEITS TURN AT PLAY
PLAYER DEBITS HIS GAME SCORE BY 500 POINTS
PLAYER ACHIEVES THREE OF A KIND; CONTINUES TURN
PLAYER FAILS TO ACHIEVE THREE OF A KIND; FORFEITS TURN AT PLAY
PLAYER ACHIEVES LESS THAN REQUIRED SCORE VIA SOME OF THE DICE
PLAYER THROWS OTHER, NON-POINT YIELDING DICE
PLAYER FAILS TO ACHIEVE REQUIRED SCORE; YIELDS TURN AT PLAY
PLAYER ACHIEVES REQUIRED SCORE; STILL HAS ONE OR MORE DICE WHICH EARNED NO POINTS
PLAYER THROWS REMAINING DIE OR DICE; ACHIEVES NO MORE POINTS; FORFEITS ALL TURN-AT-PLAY POINTS
PLAYER THROWS REMAINING DIE OR DICE; ACHIEVES MORE POINTS

METHOD OF PLAYING A GAME OF CHANCE

The invention pertains to methods of playing games of chance. In particular the invention pertains to method of playing games of chance, and the like comprising game cards and dice. The element of chance comes into play by means of the luck of the draw when the player picks a card and also by means of the roll of the dice.

It is the object of this game to provide a new game-play method which comprises an element of chance, is simple to play and can be played by two or more players either as individuals or as teams.

It is particularly an object of this game to teach a method for playing a game of chance comprising the steps of providing dice; providing a deck of discrete cards which have game-play instructions and enumerated point-goals indicated thereon; assigning a predetermined point to at least one given die face; assigning a predetermined point to at least one plurality of a given die face; selecting a card from said deck thereof and noting any point-goal indicated thereon; throwing said dice; noting any achieved points from die faces and pluralities thereof, as thrown, which yield any such points; adding all achieved points to determine the sum thereof; noting any point underachievement of said point-goal in said sum; and again throwing only such die or dice which yielded no points, in order to endeavor to achieve such points therefrom as will equal or exceed point underachievement.

Further objects of the invention, as well as the novel features thereof, will become apparent when one studies the following description of the embodiment of the invention in conjunction with the accompanying FIGURE.

The FIGURE is a flow diagram describing the game-play chance paths which may be undertaken by the players.

The object and overall goal of the game is to score a set number of points. The game materials comprise six dice and a set of game cards, and the cards prescribe, for the player, a goal to be acheived by a throw of the dice in a turn at play. Ultimately, over the succeeding turns at play, the prescribed set numbers of points, or overall game totals are to be achieved. The overall total or goal is 10,000 points for singles, 15,000 points for partners and 20,000 points for teams. To play the game, the player picks up a card from the pre-shuffled card deck; see the flow-diagram. This card will prescribe for him a minimum goal to shoot for in that turn at play. The player then rolls six dice and then counts the points accumulated according to the following chart. If the player reaches the goal for that turn in one roll, he may stop at that time. If he has not reached his goal, he again rolls only the dice (or die) not included in the scoring (i.e., if three dice gave him a point score in the first roll, he must then roll only the other three). In any roll in which a player does not roll any points, that turn at play is terminated, and any points accumulated in that turn at play are forfeited. A further element of chance is brought to bear at this point. A player who reaches his card-prescribed goal for that turn at play in one or two rolls of the dice, then must decide whether to go for more points and risk all the points which he has already accumulated in that turn at play. To explain this further: if a player has a card-prescribed goal of one thousand points to achieve in a turn at play, and he makes this in two rolls of the dice—and has achieved this with five dice—he still may throw the sixth die. The sixth die may yield him further points. However, if the sixth die does not yield him further, additional points (ie. points which he was not required to make), he forfeits all the points which he made in his turn at play; see the flow-diagram.

The following is the point value list for the scoring system of the game:

| | | |
|---|---|---|
| Five of a kind in one roll: | | |
| 1's | 1,500 | Points |
| 2's | 2,000 | " |
| 3's | 3,000 | " |
| 4's | 4,000 | " |
| 5's | 5,000 | " |
| 6's | 6,000 | " |
| Three of a kind in one roll: | | |
| 1's | 1,000 | Points |
| 2's | 200 | " |
| 3's | 300 | " |
| 4's | 400 | " |
| 5's | 500 | " |
| 6's | 600 | " |
| Individual die values: | | |
| 1 | 100 | Points |
| 5 | 50 | " |

Therefore a roll of dice that comes up with four 1's and two 2's is worth 1,100 points. This is totaled by adding the points gained for rolling three of a kind with the addition of one additional 1 worth a hundred points.

If an individual rolls double threes of a kind on the initial roll, he may add those points and then get an additional turn with all six dice. With this exception, then, a player may only continue play in a given turn by throwing only such dice as produce no points in a prior throw.

The game cards consist of the following:

5 Bonus Cards;
5 Lose A Turn Cards;
5 Three Of A Kind Cards;
3 Lose 500 Points Cards;
22 Cards numbered 100–1000 points; and
20 Cards numbered 150–950 points.

To make up the total of 22 cards of "100" through "1000" points, there are duplicates of each of these—i.e., two "100" point cards, two "200" point cards, etc., and finally, there are thirds of the "100" and "1000" point cards. So also, with the "150" through "950" point cards; there are duplicates of each, with an extra third card for each of the "150" and "950" point cards. This is the prescribed card deck, according to this embodiment of the game. Patently, other pluralities of mixes of the point cards can be used in other embodiments. That is, as desired, only singles of lower (or higher) point cards, and greater pluralities of the higher (or lower) point cards can be used.

The Bonus Cards have no point value. A player who pulls this card on his turn has no minimum goal to shoot for and he may save whatever points he accumulates as long as a "no-point" roll does not come up.

The Lose A Turn Cards will forfeit a player's turn.

The Three Of A Kind Cards require that a player roll three of a kind in his first roll. If he does, he is allowed to continue play, accumulating those and any further points. If not, if he fails to make three of a kind in his first roll of the six dice, the turn is forfeited.

The Lose 500 Points Cards take 500 points from a player's total. If a player does not have 500 points, his total will then go into minus figures. The "points" cards prescribe the minimum point values that a player must shoot for on each turn. The accompanying flow-diagram figure depicts the game-play steps which follow from the player's draw of each of the above-cited game cards.

As one can readily see from the disclosed embodiment, the game is designed to include an element of chance. It is also the purpose of the game to be simple to play, to be enjoyable, and to give a player the choice as to whether to proceed in his turn or not. This enhances the game as far as giving the player some control over the chance aspect of the game. Particularly novel is the use of six dice, rather than the customary two, and the game-prescribed step of throwing, in a successive attempt at points, only the die or dice which—in a prior turn at play throw—did not yield any points. Especially punative, if interesting from the pleasure and chancy aspect of the game, is the forfeiture of any points gained in a turn at play upon throwing no points at all in a throw of die or dice during that turn. Too, while in the prior art it is typical to assign different point values to all faces of the dice, my game-play dictates that only the one-dot and five-dot faces yield individual points. Thus, on rolling the six dice, and turning up two one-dot faces, one five-dot face, one four-dot face, one two-dot face, and one six-dot face—for instance—only the two one-dot faces and the one five-dot face yield points: 200 points for the former and 50 points for the latter. The other faces produce no points. However those non-point-yielding three dice are thrown again, or may be if the point goal was not 250. As noted in the preceding text, if the goal was 250, and the player turned up the two one-dot faces and one five-dot face, he may yield succeeding play to his opponent. He does not have to try for more points within the non-point-yielding dice. It is his choice; he may go on to try for more points, or not, as he wishes. The only time that a player must continue to throw the die or dice in a turn at play is when any prior throw in that turn yielded him less than the point total prescribed by the card which he drew from the deck.

By taking teaching from my disclosure, those skilled in devising games of chance and the like, will appreciate that, in alternative embodiments, the game-play can assign point values to other die faces, or additional die faces. Too, different point values can be assigned to two of a kind in a roll of the dice, or four of a kind; differing pluralities of the discrete game cards can be used, in variations of my game, if desired. However, clearly, all such alterations and variations are wholly within the ambit of my invention.

Accordingly, while I have described my invention in connection with a specific set of game-play steps, with use of a prescribed embodiment of game apparatus, it is clearly to be understood that this is done only by way of example and not as a limitation to the scope of my invention as set forth in the objects thereof and in the claims.

I claim:

1. A method of playing a game of chance, comprising the steps of:

providing dice;

providing a deck of discrete cards which have game-play instructions and enumerated point-goals indicated thereon;

assigning a predetermined point to at least one given die face;

assigning a predetermined point to at least one plurality of a given die face;

selecting a card from said deck thereof and noting any point-goal indicated thereon;

throwing said dice;

noting any achieved points from die faces and pluralities thereof, as thrown, which yield any such points;

adding all achieved points to determine the sum thereof;

noting any point underachievement of said point-goal in said sum; and again throwing only such die or dice which yielded no points, in order to endeavor to achieve such points therefrom as will equal or exceed said point underachievement.

2. A method, according to claim 1, wherein:

said point-assigning steps comprising assigning a point value to die faces having a single dot.

3. A method, according to claim 1, wherein:

said point-assigning steps comprise assigning a first point value to die faces having a single dot, and assigning a second point value to die faces having five dots.

4. A method, according to claim 3, wherein:

said point-assigning steps further comprise assigning a third point value to triples of any one die face, and a fourth point value to quintuples of any one die face.

5. A method, according to claim 1, wherein:

said point-assigning steps comprise assigning a first point value to triples of any one die face, and a second point value to quintuples of any one die face.

6. A method, according to claim 1, further including the step of:

abandoning a turn at play to another player, on achieving no points in any of said die or dice-throwing steps.

7. A method, according to claim 1, further including the steps of:

forfeiting any achieved points made in any prior die or dice-throwing steps, on achieving no points in any succeeding die or dice-throwing steps; and abandoning a turn at play to another player.

* * * * *